US006889952B2

(12) United States Patent
Cook et al.

(10) Patent No.: US 6,889,952 B2
(45) Date of Patent: May 10, 2005

(54) MULTI-POSITION PRESENTATION EASEL

(75) Inventors: Ronald D. Cook, Riverside, CA (US); Pamela J. Emken, Lake Mathews, CA (US)

(73) Assignee: Boone International, Inc., Lincolnshire, IL (US)

( * ) Notice: Subject to any disclaimer, the term of this patent is extended or adjusted under 35 U.S.C. 154(b) by 0 days.

(21) Appl. No.: 10/286,354

(22) Filed: Nov. 1, 2002

(65) Prior Publication Data

US 2003/0173488 A1 Sep. 18, 2003

(Under 37 CFR 1.47)

Related U.S. Application Data

(60) Provisional application No. 60/330,911, filed on Nov. 2, 2001.

(51) Int. Cl.[7] ..... A47B 97/04

(52) U.S. Cl. ..... 248/458; 248/448

(58) Field of Search ..... 248/458, 441.1, 248/447, 448, 460, 462, 463, 464, 449

(56) References Cited

U.S. PATENT DOCUMENTS

| | | | | | |
|---|---|---|---|---|---|
| 2,456,720 | A | | 12/1948 | Miles | |
| 2,912,203 | A | | 11/1959 | Townsend | |
| 3,006,107 | A | | 10/1961 | Tolegian | |
| 3,095,666 | A | * | 7/1963 | Killen | 248/449 |
| 3,107,442 | A | | 10/1963 | Levine | |
| 3,122,858 | A | * | 3/1964 | Kadin | 248/449 |
| 3,145,966 | A | * | 8/1964 | Landon | 248/464 |
| 3,195,849 | A | | 7/1965 | Maddox | |
| 3,368,786 | A | * | 2/1968 | Bulman | 248/455 |
| 3,738,606 | A | | 6/1973 | Millen | |
| 3,759,482 | A | * | 9/1973 | Wright | 248/449 |
| 3,828,694 | A | * | 8/1974 | Nestler et al. | 108/10 |
| 3,926,398 | A | | 12/1975 | Vincent | |
| 4,063,648 | A | | 12/1977 | Fuller et al. | |
| 4,098,009 | A | | 7/1978 | Flynn | |
| 4,109,892 | A | | 8/1978 | Hartung | |
| 4,154,173 | A | * | 5/1979 | Chesnut | 108/6 |
| 4,249,336 | A | | 2/1981 | Moe et al. | |
| 4,270,462 | A | | 6/1981 | Driscoll | |
| 4,703,910 | A | * | 11/1987 | Ross | 248/463 |
| 4,717,109 | A | | 1/1988 | Johnston | |
| 4,971,284 | A | * | 11/1990 | Curry | 248/460 |
| 4,988,068 | A | * | 1/1991 | Yamana et al. | 248/484 |
| 5,004,204 | A | | 4/1991 | Cook | |
| 5,074,513 | A | | 12/1991 | Presley et al. | |
| 5,161,766 | A | | 11/1992 | Arima | |
| 5,197,393 | A | * | 3/1993 | Yeakle | 108/10 |
| 5,219,142 | A | | 6/1993 | Potter | |
| 5,329,712 | A | | 7/1994 | Keller | |
| 5,478,040 | A | | 12/1995 | Rellinger et al. | |
| 5,494,251 | A | | 2/1996 | Katz | |
| 5,697,595 | A | | 12/1997 | Sperber | |
| 5,725,192 | A | * | 3/1998 | Cloninger | 248/458 |

(Continued)

FOREIGN PATENT DOCUMENTS

| | | |
|---|---|---|
| DE | 004221637 A1 | 1/1994 |
| DE | 004401348 A1 | 7/1995 |
| DE | 019508393 A1 | 10/1995 |
| DE | 019745512 A1 | 4/1999 |
| DE | 197 48 983 | 5/1999 |

(Continued)

*Primary Examiner*—Anita M. Kin
(74) *Attorney, Agent, or Firm*—Michael Best & Friedrich LLP

(57) ABSTRACT

The present invention is directed to a portable easel having a frame and a display panel movably coupled to the frame. The panel is movable with respect to the frame in a longitudinal direction, and the panel is rotatable with respect to the frame from a first predetermined angular position to a second predetermined angular position.

20 Claims, 10 Drawing Sheets

U.S. PATENT DOCUMENTS

| | | | | |
|---|---|---|---|---|
| 5,791,623 | A * | 8/1998 | Louridas | 248/451 |
| 6,089,167 | A | 7/2000 | Frohardt | |
| 6,170,792 | B1 | 1/2001 | Miceli et al. | |
| 6,193,204 | B1 | 2/2001 | Hsu | |
| 6,390,433 | B1 * | 5/2002 | Kasa-Djukic | 248/441.1 |

FOREIGN PATENT DOCUMENTS

| | | | |
|---|---|---|---|
| EP | 0 421 038 | | 4/1991 |
| EP | 0 628 267 | A2 | 12/1994 |
| GB | 2 290 466 | | 1/1996 |
| JP | 409191966 | A | 7/1997 |
| JP | 410099155 | A | 4/1998 |
| JP | 411056508 | A | 3/1999 |
| JP | 411225841 | A | 8/1999 |
| WO | WO 92/20261 | | 11/1992 |
| WO | WO 95/27421 | | 10/1995 |

* cited by examiner

MULTI-POSITION PRESENTATION EASEL

RELATED APPLICATIONS

This application claims priority to U.S. Provisional Application No. 60/330,911 filed on Nov. 2, 2001.

FIELD OF THE INVENTION

The invention relates to a presentation system and more particularly to a presentation easel for supporting a multi-positional presentation board.

BACKGROUND OF THE INVENTION

Easels have been provided for supporting a board or other display items during a presentation. Commonly easels have tripod leg stands and are between five and six feet tall. The rear leg extends backward to form an inclined surface along the front legs. Sometimes the easels are equipped with pegs or a shelf about halfway down the front two legs. Display items rest on the pegs or shelf and against the legs. Alternatively, the top of the legs contain a pin or attachable bar which holds the display items suspended and resting on the upper portion of the legs. Alternatively, the presentation easel contains a rectangular metal, plastic or fiber backing board surface mounted on tripod or quad leg supports. The legs are generally retractable so that the height of the presentation easel is adjustable. The front of the easel is normally equipped with a bar of pins for hanging a flip chart pad. Fixed or attachable shelves or a storage compartment located at the front bottom of the backing board holds markers, erasers and other accessories or the like. Some models contain one or more fixed compartments mounted on the rear of the backing board for storage of additional accessories.

Often a person making a presentation must reach distant areas of the board to refer to presentation material, which can be difficult and tiring. In easels that have made provision for adjustment of the board or display item, the adjustability is limited or cumbersome.

SUMMARY OF THE INVENTION

The present invention is directed to a portable easel having a frame including a front leg member, at least one rear leg assembly connected to the frame to support the frame in a substantially upright position, and a display panel movably coupled to the frame. The panel is movable with respect to the frame in a longitudinal direction, and the panel is rotatable with respect to the frame from a first predetermined angular position to a second predetermined angular position.

In a preferred embodiment, the panel is a dry-erase board and the easel further comprises a positioning assembly coupled to the frame for positioning the dry-erase board with respect to the frame. The positioning assembly includes a stationary plate connected to the frame and a position cart movably coupled to the stationary plate. The position cart includes a slide plate movable with respect to the stationary plate in the longitudinal direction and a pivot plate connected to the board and operatively connected to the slide plate and rotatable with respect to the slide plate to position the board with respect to the frame.

In another embodiment, the panel is movable with respect to the frame in a longitudinal direction from a first predetermined vertical position to a second predetermined vertical position.

DETAILED DESCRIPTION OF THE PREFERRED EMBODIMENTS

Figure 1:
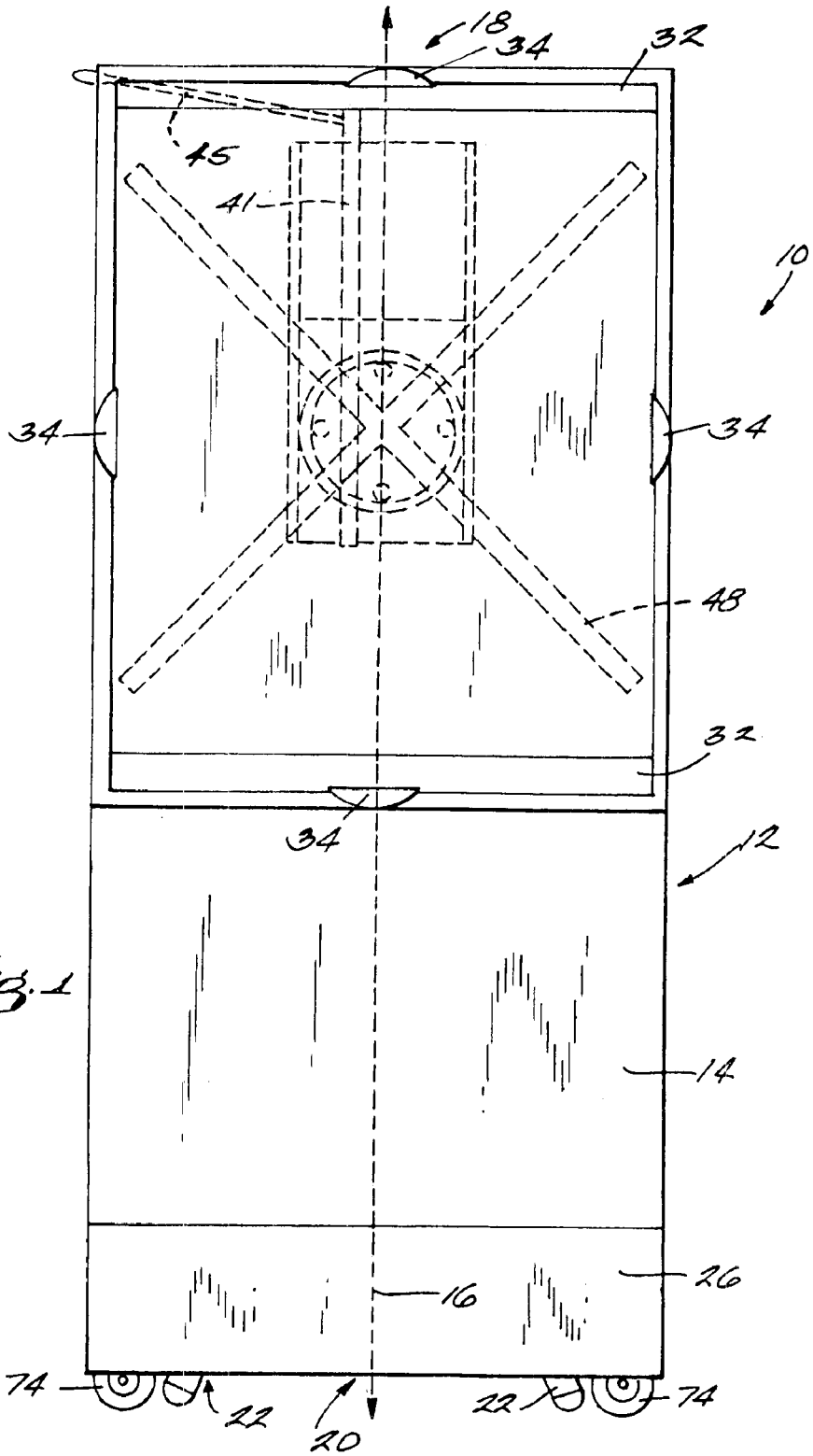
FIG. 1 is a front elevation view of an easel constructed according to the present invention with the display panel thereof shown in a portrait position.
Figure 2:
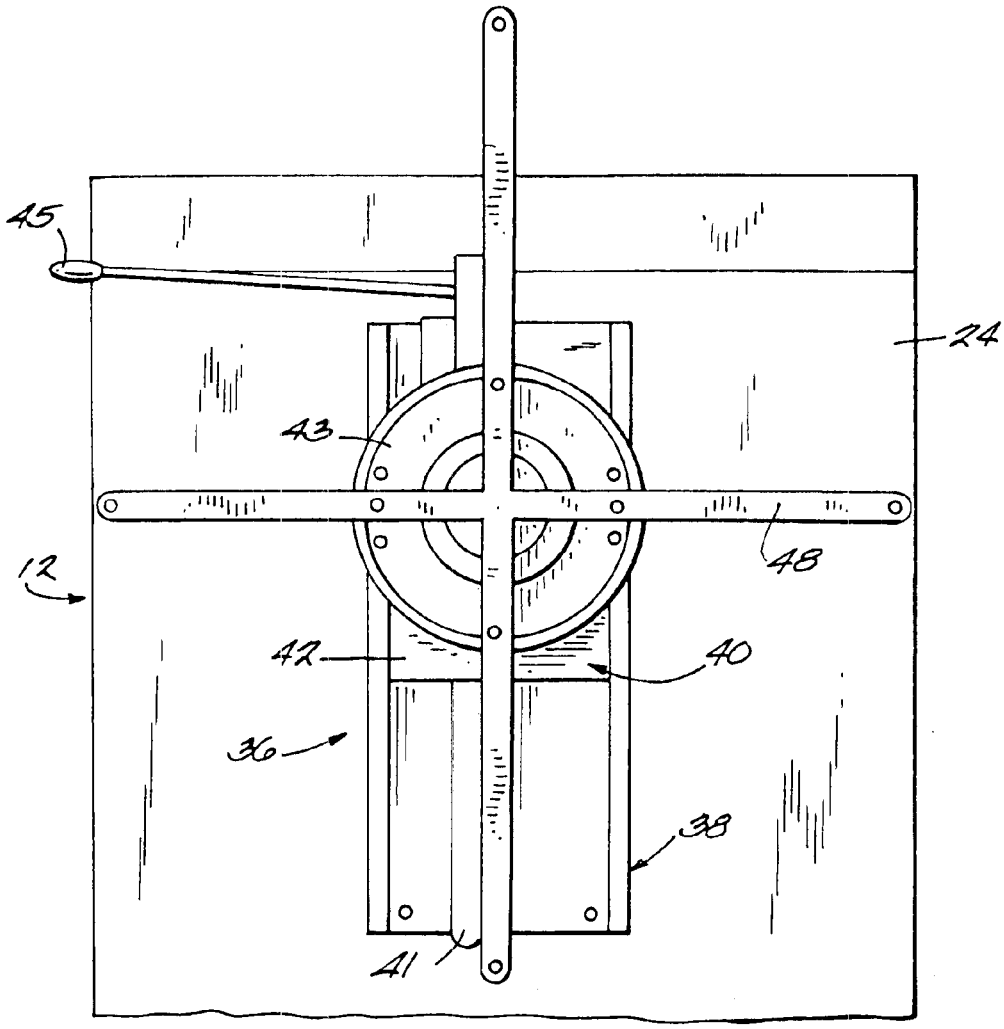
FIG. 2 is a front view of the easel of FIG. 1 with the display panel thereof removed.

Referring to FIGS. 1–4, a first embodiment of a presentation easel constructed according to the present invention is shown generally at 10. Presentation easel 10 comprises a frame 12 including a front leg member 14 having a longitudinal axis 16 extending from a top end 18 to a bottom end 20 and at least one rear leg assembly 22 to support the frame 12 in a substantially upright position. In one preferred embodiment, a kick plate 26 is positioned adjacent bottom end 20 and is made from a generally rigid material to minimize damage to front leg member 14 if it is accidentally kicked. Rear leg assembly 22 is hingedly connected to the top portion of front leg 14 along top end 18 and is pivotable with respect to the front leg 14 so that the easel can be folded flat for portability or storage and can be extended rearward to support the frame in a substantially upright position. In a preferred embodiment, hinge 15 extends across the entire width of the top portion of front leg 14, however, in alternative embodiments, hinge 15 can extend along only a portion of the width and/or a plurality of hinges can be used. Front leg 14 includes a main body 24 for supporting a board or display panel 28. Display panel 28 is preferably rectangular and has a main viewing and support surface 30 on the front side thereof. Of course, panel 28 can have varied shapes and configurations. In the preferred embodiment, surface 30 comprises a surface that can be repetitively written upon and erased, such as a dry-erase board or chalk board.

Figure 3:
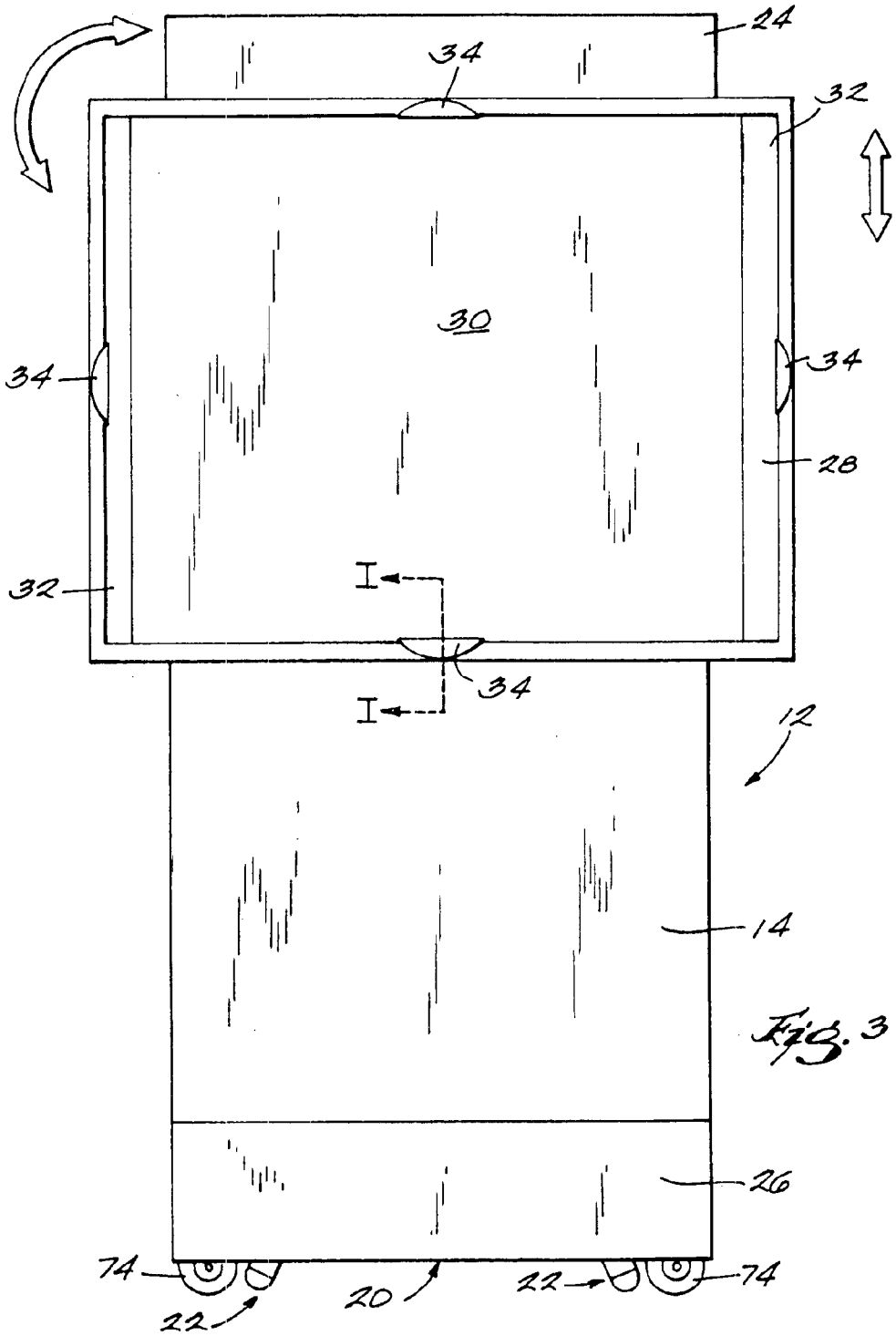
FIG. 3 is a front view of the easel of FIG. 1 with the display panel thereof shown in a landscape position.
Figure 4:
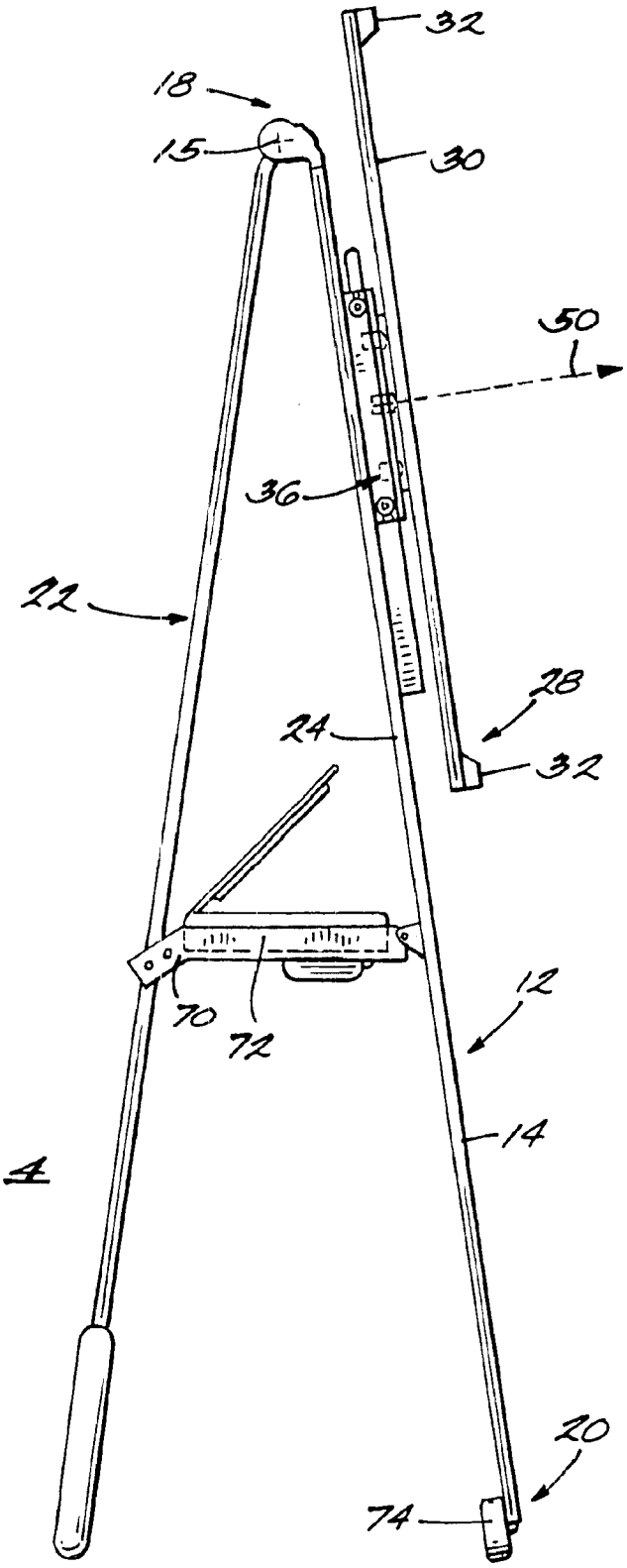
FIG. 4 is a side view of the easel.
Figure 5C:
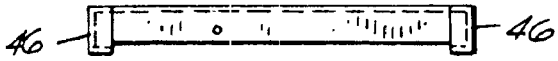
FIGS. 5A, 5B, and 5C are front, side, and top views, respectively, of the stationary plate of the positioning assembly of FIG. 2.
Figure 5A:
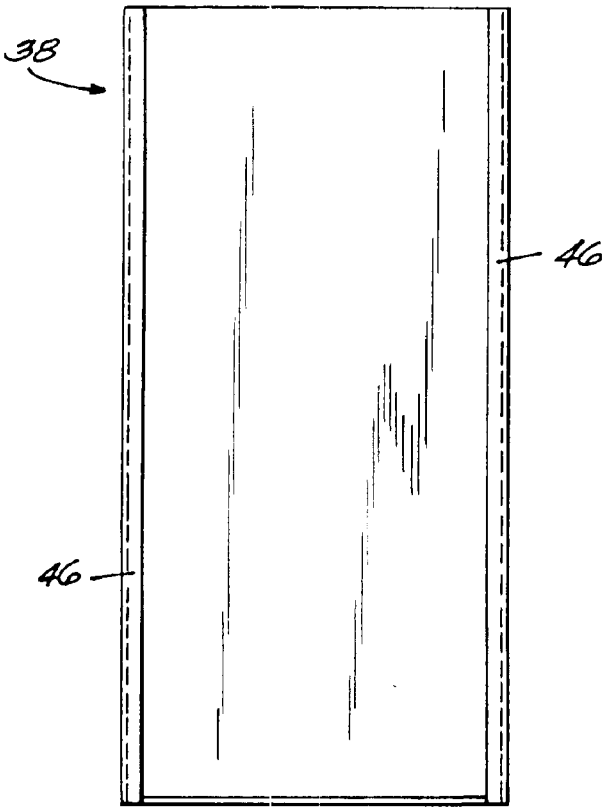
Figure 5B:
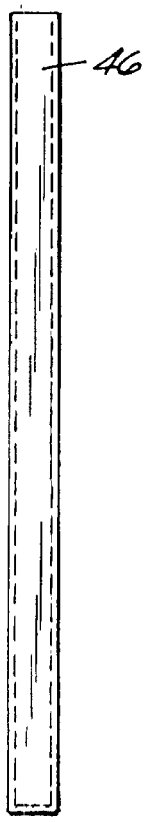

Panel 28 can also serve as a clip board for holding single or multiple pages and includes at least one clip 32 to hold a display object. As best seen in FIGS. 1, 3, and 4, in a preferred embodiment, a pair of clips 32 are disposed along the top and bottom edges of the panel, and preferably extend along the entire width thereof. Clips 32 are hingedly connected to panel 28 and include a clamping portion biased against support surface 30 for holding display items, such as paper, photographs, charts or the like, against panel 28. Also, in a preferred embodiment, panel 28 includes handles 34 disposed along each side of the panel to facilitate the movement of panel 28 into a desired position or orientation.

The display panel 28 is movably coupled to frame 12 so that the panel can move longitudinally and rotationally with respect to frame 12. In the preferred embodiment, the display panel 28 is movable between numerous preset or predetermined positions so that panel 28 can be easily and quickly repositioned as desired by the user and the panel will lock in a desired predetermined position. In this way, the display panel can be moved vertically and reoriented angularly to different set positions during a presentation in one motion and without the need to separately lock the panel in place such as by tightening set screws, etc. Also the numerous preset or predetermined positions of display panel 28 assures the user that the panel is at a desired height or in a desired orientation and the user does not have to guess whether the panel is in the proper orientation. As a result, the movement of display panel 28 requires less adjustments and is more intuitive to a user. Thus, easel 10 advantageously allows the presenter to have more freedom during a presentation and minimizes time spent fidgeting with presentation equipment.

In the vertical or longitudinal direction, panel 28 is slidable with respect to front leg 14 and is preferably lockable in any desired vertical position. In alternative embodiments, panel 28 may be lockable in a plurality of predetermined vertical positions spaced along a portion of the front leg 14. Preferably, panel 28 can travel at least eight inches in the vertical direction, however the length of vertical travel can be varied in alternate embodiments. Similarly, panel 28 is rotatable with respect to front leg 14 between a plurality of predetermined angular positions spaced angularly along a portion of front leg 14. As can be seen in FIGS. 1 and 3, easel 10 can be rotated between a substantially portrait position (FIG. 1) and a substantially landscape position (FIG. 3).

In one preferred embodiment, panel 28 is coupled to frame 12 via a positioning assembly 36 to precisely position panel 28 with respect to frame 12. Referring to FIGS. 2, and 4–6, the positioning assembly 36 generally includes a stationary plate 38 fixedly connected to frame 12 and a position cart 40 movably coupled to the stationary plate 38. The position cart 40 comprises a slide plate 42 and a pivot plate 43 operatively connected to stationary plate 38. Slide plate 42 is movable with respect to stationary plate 38 in the longitudinal direction. In the preferred embodiment, slide plate 42 is slidably received within stationary plate 38 and includes a plurality of wheels 44 that engage rails 46 of the stationary plate 38. However, in alternate embodiments, slide plate 42 can have different configurations. Pivot plate 43 is coupled on one side to panel 28 via a crossbar member 48 and is operatively connected on the other side to slide plate 42. Crossbar 48 is preferably fixedly attached to pivot plate 43, such as by screws. Pivot plate 43 is rotatably connected to slide plate 42 about a pivot axis 50 that extends substantially perpendicular to surface 30 and longitudinal axis 16.

In a preferred embodiment, a gas spring or pneumatic cylinder 41 (shown in FIG. 2) extends in the longitudinal direction and is attached to slide plate 42 to facilitate the movement of slide plate 42 in the longitudinal or vertical direction. Pneumatic cylinder 41 includes a handle 45 that is movable to a release position that releases pressure in the cylinder to permit slide plate 42 to move in the vertical direction. Also, handle 45 is movable to a locking position to prevent movement of slide plate 42 or lock slide plate 42 in place at any desired vertical position. One preferred gas spring is available from Magnus Mobility Systems, Inc. of Orange, Calif., under the name BLOCK-O-LIFT. However, similar gas springs can be used in the alternative.

Figure 6C:
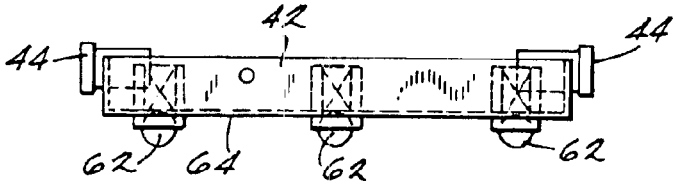
FIGS. 6A, 6B, and 6C are front, side, and top views, respectively, of the slide plate of the positioning assembly of FIG. 2.
Figure 6A:
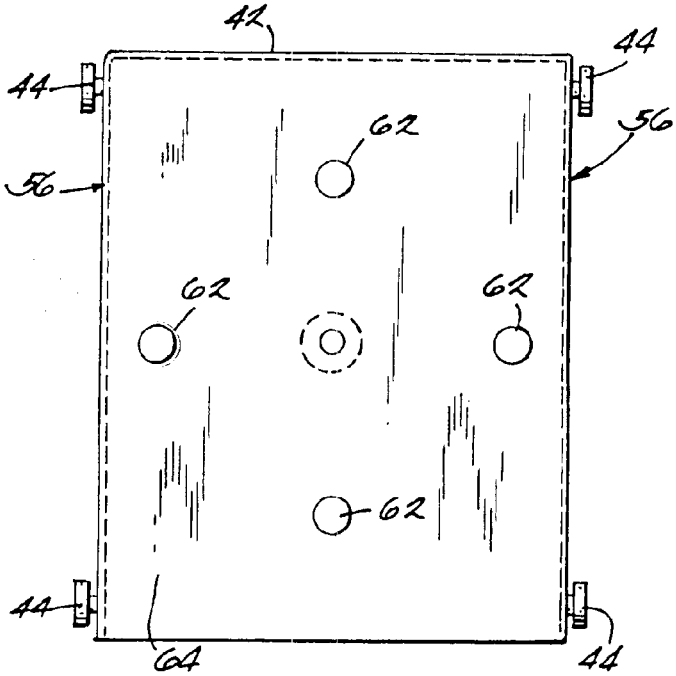
Figure 6B:
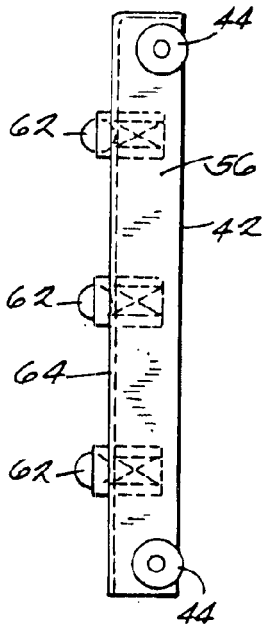

Referring to FIGS. 6A–6C, positioning assembly 36 includes a plurality of locking mechanisms or ball detent mechanisms 62 for lockingly positioning the pivot plate 43 in mechanically preset or predetermined positions. Ball members 62 are spring loaded and extend outward from the front 64 of slide plate 42 and engage holes or detents 68 in pivot plate 43 to lockingly position pivot plate 43 in the angular direction. Holes 68 are spaced angularly around pivot plate 43 to define a plurality of preset angular positions or mechanical presets in which the pivot plate 43 can be registered or set.

Figure 7A:
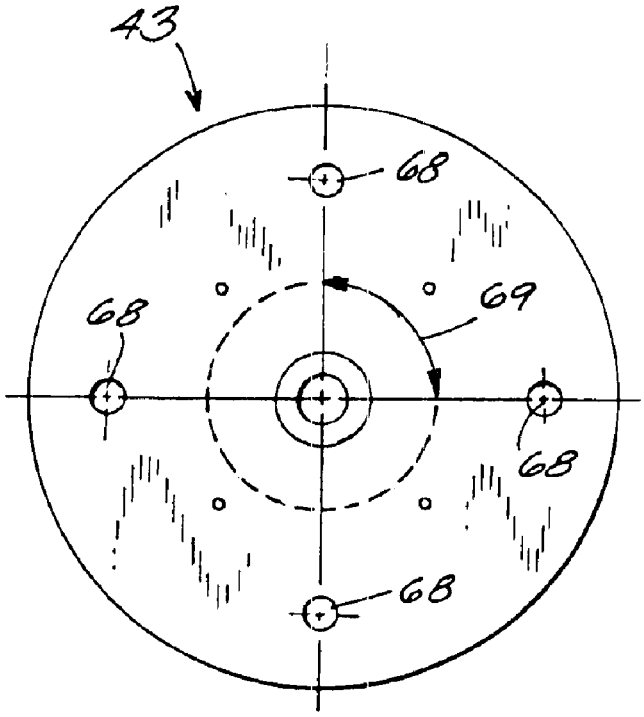
FIGS. 7A and 7B are front and side views, respectively, of the pivot plate of the positioning assembly of FIG. 2.
Figure 7B:
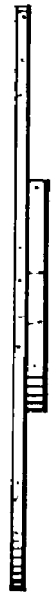

Referring to FIGS. 7A and 7B, in a preferred embodiment, at least four holes or detents 68 are formed in pivot plate 43 and spaced angularly around axis 50. In this configuration, the detents are separated by an angle 69 of about 90 degrees and panel 28 can be rotated between a substantially portrait position and a substantially landscape position. Because detents 68 are arranged to orient panel 28 in predetermined positions, the user does not have to guess whether the panel has been rotated a set distance, i.e. in this embodiment 90 degrees. Of course, more or less detents can be included and the angular spacing can be varied.

As panel 28 is rotated from a first predetermined angular position to a second predetermined angular position, ball members 62 are dislodged from their respective detents at the first position and the balls 62 contact the generally smooth underside of pivot plate 43 and rotate to facilitate reduced frictional movement of pivot plate 43. When balls 62 are aligned with detents 68 corresponding to a second predetermined position, balls 62 automatically engage detents 68 and lock the plates in the second predetermined position. In a preferred embodiment, display panel 28 is manually rotatable from the first angular position to the second angular position without having to adjust a locking mechanism in order to fix the panel in position.

Figure 8C:
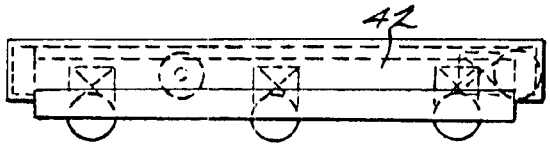
FIGS. 8A, 8B, and 8C are front, side, and top views, respectively, of an alternative embodiment of the positioning assembly.
Figure 8A:
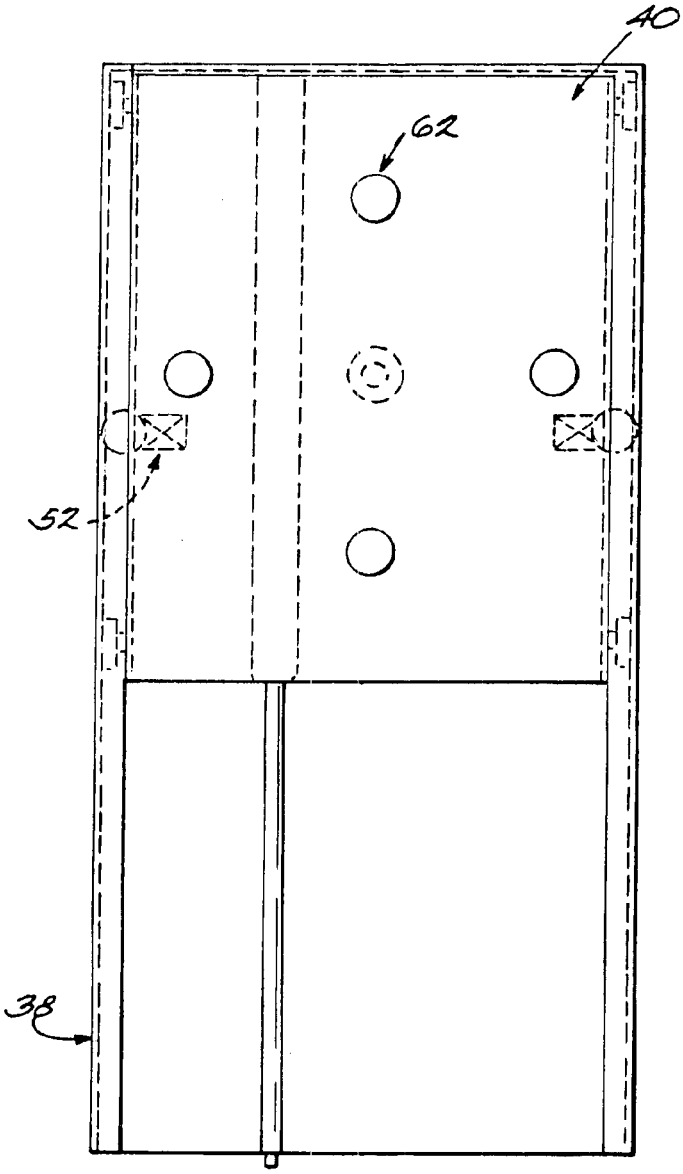
Figure 8B:
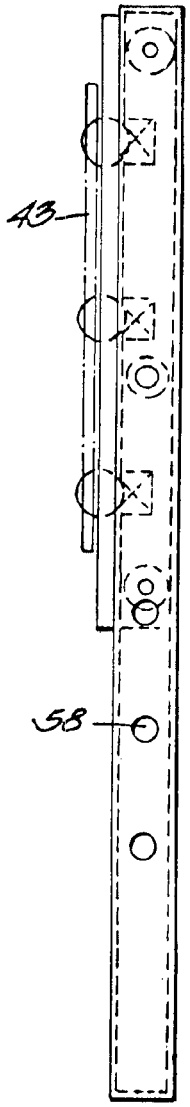

In an alternative embodiment, shown in FIGS. 8A–8C, positioning assembly 36 can include a plurality of locking mechanisms or ball detent mechanisms 52 extending laterally from opposing sides 56 of slide plate 42 for lockingly positioning the slide plate 42 in predetermined vertical positions. In this embodiment, ball members 54 are spring loaded and extend laterally outward from opposing sides 56 of slide plate 42 and engage holes or detents 58 in stationary plate 38 to lockingly position the slide plate in the longitudinal direction. Detents 58 are spaced longitudinally along rails 46 of the stationary plate to define a plurality of preset vertical positions or mechanical presets in which slide plate 42 can be set. Preferably, stationary plate 38 preferably includes at least five holes or detents formed in the lateral portion of rails 46 and spaced longitudinally along axis 16. Of course, more or less detents can be included and the longitudinal spacing can be varied.

As best seen in FIGS. 1 and 3, in a preferred embodiment, easel 10 includes wheels 74 mounted on front leg 14 to facilitate transportation of the easel around a room. In alternate embodiments, wheels 74 can be mounted on rear leg assembly 22.

Figure 9:
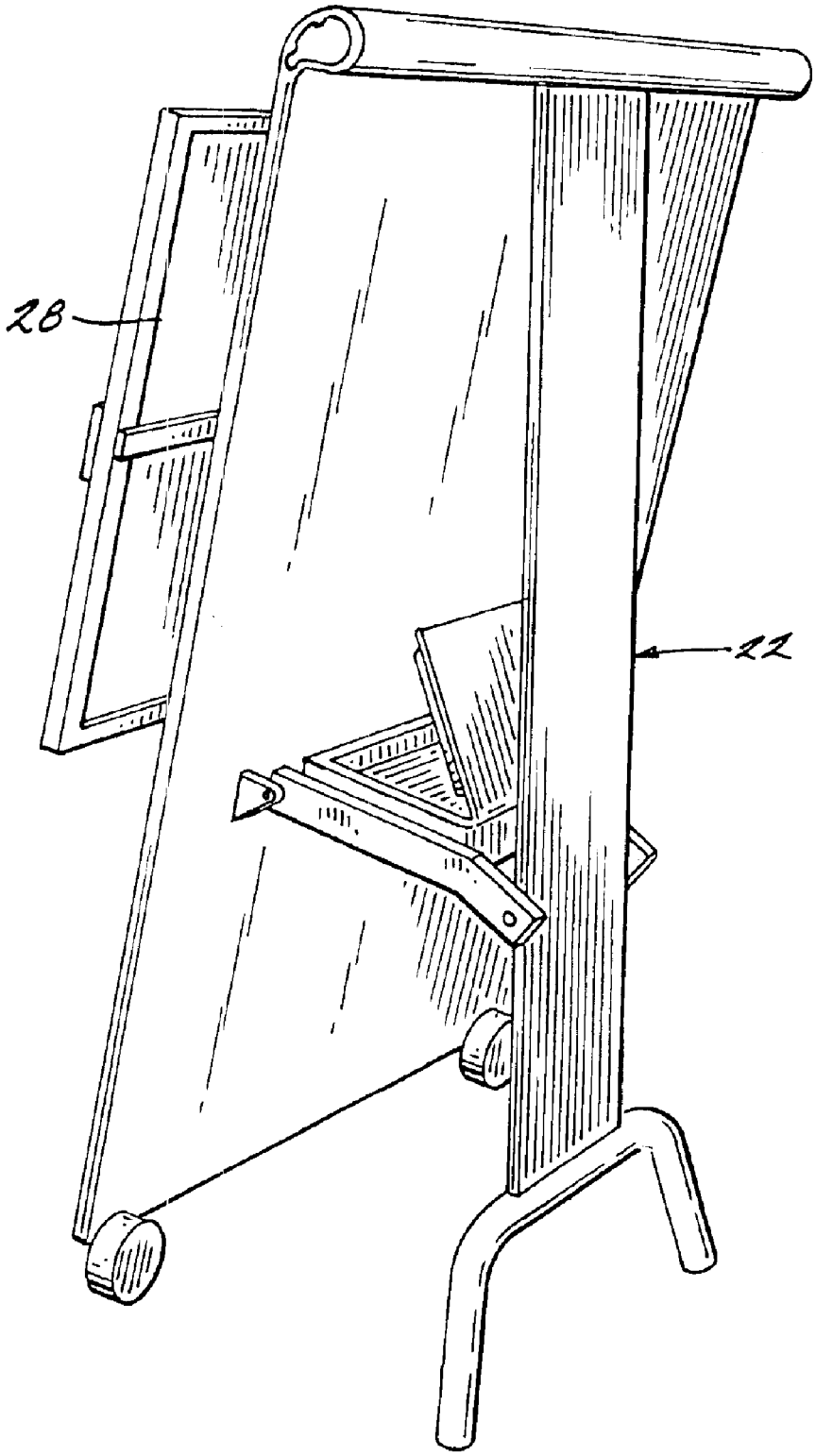
FIG. 9 is a rear perspective view of the easel.
Figure 10:
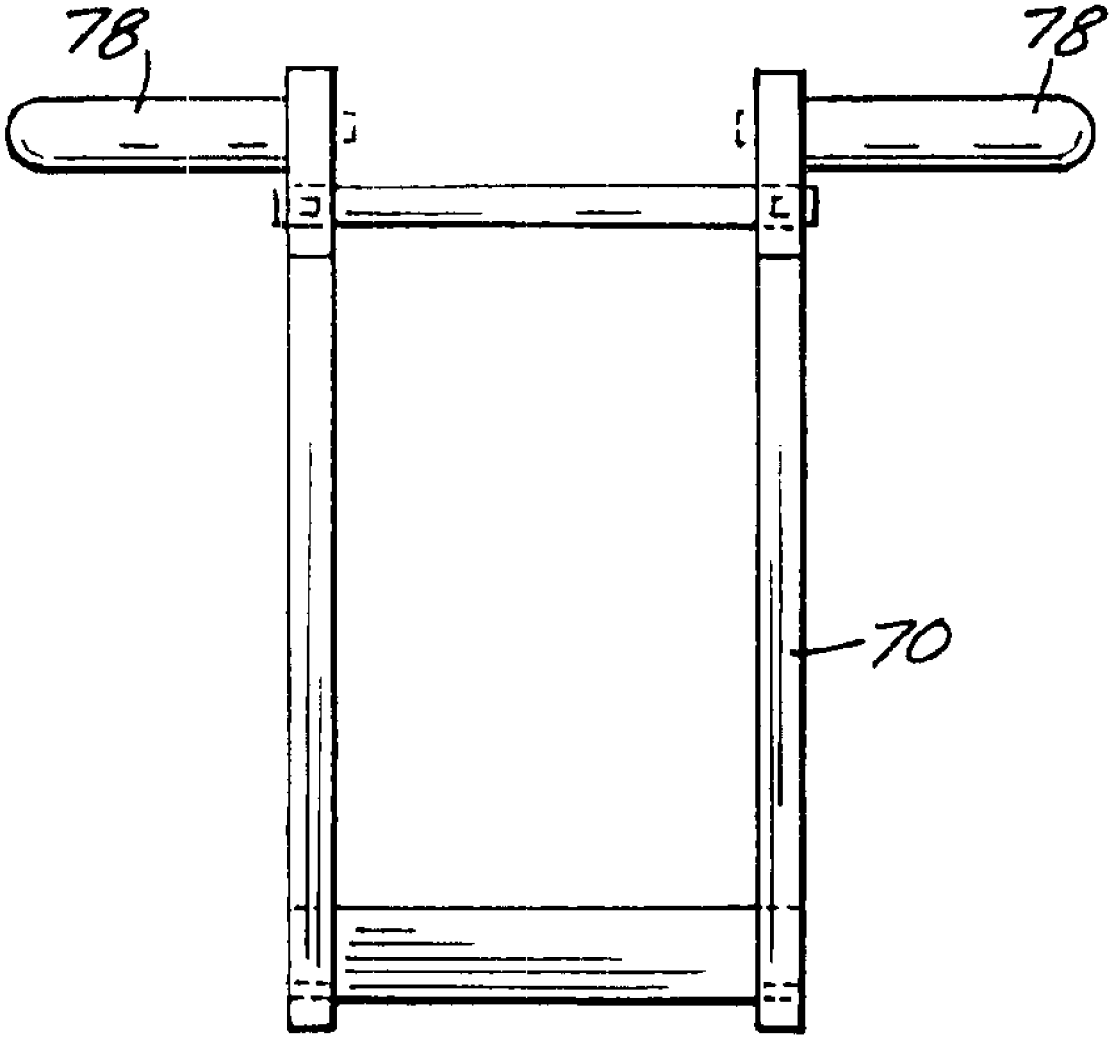
FIG. 10 is a top view of the tray support frame.

Referring to FIG. 3, a tray support frame 70 for holding a tray 72 is hingedly connected to the back of frame 12 and pivotable with respect thereto so that when easel 10 is folded flat, frame 70 and tray 72 lay substantially flat with respect to the back of front leg 14. Referring to FIGS. 9 and 10, a pair of handles 78 extend from one end of frame 70 and extend laterally with respect to rear leg assembly 22 to further facilitate movement of frame 12 in a room, such as by rolling.

While it is apparent that the illustrative embodiments of the invention herein disclosed fulfil the objectives stated above, it will be appreciated that numerous modifications and other embodiments may be devised by those skilled in the art. Therefore, it will be understood that the appended claims are intended to cover all such modifications and embodiments which come within the scope of the present invention.

What is claimed:

1. A portable easel, comprising:

a frame including a front leg member having a longitudinal axis extending from a top end to a bottom end;

a display panel movably coupled to the frame, wherein the panel is movable with respect to the frame in a longitudinal direction, and the panel is rotatable with respect to the frame;

a positioning assembly including a locking mechanism for locking the angular position of the display panel in one of a plurality of discrete predetermined positions, the discrete predetermined positions including at least a first predetermined angular position and a second predetermined angular position; and at least one adjustable rear leg assembly connected to the frame to support the frame in a substantially upright positions;

wherein the positioning assembly is coupled to the frame for positioning the panel with respect to the frame, the positioning assembly including, a stationary plate fixedly connected to the frame; and a position cart movably coupled to the stationary plate, the position cart including, a slide plate operatively connected to the stationary plate and movable with respect thereto in the longitudinal direction; and a pivot plate connected to the panel and operatively connected to the slide plate and rotatable with respect to the slide plate to position the panel with respect to the frame.

2. The easel of claim 1, wherein the first predetermined angular position is separated from the second predetermined angular position by at least an angle of about 90 degrees.

3. The easel of claim 1, wherein the panel is in a substantially portrait position in the first predetermined position and the panel is in a substantially landscape position in the second predetermined position.

4. The easel of claim 1, wherein the locking mechanism lockingly positions at least one of the slide plate and pivot plate in a predetermined position.

5. The easel of claim 4, wherein the locking mechanism comprises at least one ball detent mechanism connected to at least one of the stationary plate, sliding plate, and pivot plate, to lockingly position the plates with respect to each other in at least one direction.

6. The easel of claim 4, wherein the panel is manually rotatable from the first position to the second position without adjusting the locking mechanism.

7. The easel of claim 6, wherein the panel automatically locks in the second predetermined angular position when the panel is moved from the first predetermined angular position to the second predetermined angular position.

8. The easel of claim 1, further comprising at least one wheel mounted on either the front leg or rear leg assembly.

9. The easel of claim 1, further comprising an accessory tray hingedly connected to the frame and pivotable with respect thereto.

10. The easel of claim 1, wherein the panel further comprises at least one clip to hold a display object.

11. The easel of claim 1, further comprising a pneumatic cylinder operatively connected to the display panel for facilitating movement of the panel in the longitudinal direction.

12. The easel of claim 1, wherein the display panel comprises a dry-erase board.

13. A portable easel, comprising:

a frame including a front leg member having a longitudinal axis extending from a top end to a bottom end;

a display panel movably coupled to the frame, wherein the panel is movable with respect to the frame in a longitudinal direction from at least a first predetermined vertical position to at least a second predetermined vertical position, and the panel is rotatable with respect to the frame from at least a first predetermined angular position to at least a second predetermined angular position;

a pneumatic cylinder operatively connected to the display panel for facilitating movement of the panel in the longitudinal direction; and at least one adjustable rear leg assembly connected to the frame to support the frame in a substantially upright position.

14. A portable easel, comprising:

front and rear easel support members;

a stationary plate mounted on the front support member;

a slide plate slideably engaging said stationary plate such that the slide plate may translate along a translation axis;

a pivot plate mounted on the slide plate, said pivot plate rotatable about a second axis at least substantially perpendicular to said translation axis; and a display panel mounted on said pivot plate whereby the display panel may be translated and rotated with respect o the easel support members.

15. The portable easel according to claim 14, further comprising detent means disposed on said slide plate and cooperating with said pivot plate to provide a plurality of lockable predetermined rotational positions for said display panel.

16. The portable easel according to claim 14, further comprising detent means disposed on said slide plate and cooperating with said stationary plate to provide a plurality of locatable predetermined translational positions for said display panel.

17. The easel of claim 1, wherein the locking mechanism includes at least one ball detent mechanism to lockingly position the display panel in one of the discrete predetermined positions.

18. The easel of claim 1, wherein the display panel is manually rotatable from the first predetermined angular position to the second predetermined angular position without adjusting the locking mechanism.

19. The easel of claim 1, wherein the display panel automatically locks in the second predetermined angular position when the panel is moved from the first predetermined angular position to the second predetermined angular position.

20. A portable easel, comprising:

a frame including a front leg member having a longitudinal axis extending from a top end to a bottom end;

a display panel movably coupled to the frame, wherein the panel is movable with respect to the frame in a longitudinal direction, and the panel is rotatable with respect to the frame;

a positioning assembly including a locking mechanism for locking the angular position of the display panel in one of a plurality of discrete predetermined positions, the discrete predetermined positions including at least a first predetermined angular position and a second predetermined angular position;

at least one adjustable rear leg assembly connected to the frame to support the frame in a substantially upright position; and a pneumatic cylinder operatively connected to the display panel for facilitating movement of the panel in the longitudinal direction.

* * * * *